US009936743B1

(12) United States Patent
Timberlake

(10) Patent No.: US 9,936,743 B1
(45) Date of Patent: Apr. 10, 2018

(54) PROTECTIVE BRIDGE

(71) Applicant: David Timberlake, Edmond, OK (US)

(72) Inventor: David Timberlake, Edmond, OK (US)

( * ) Notice: Subject to any disclaimer, the term of this patent is extended or adjusted under 35 U.S.C. 154(b) by 53 days.

(21) Appl. No.: 15/169,227

(22) Filed: May 31, 2016

(51) Int. Cl.
*A41D 13/05* (2006.01)

(52) U.S. Cl.
CPC ..... *A41D 13/0518* (2013.01); *A41D 13/0568* (2013.01)

(58) Field of Classification Search
CPC ..... A41D 13/0518; A41D 13/0568; A41D 13/0512; A41D 13/0151
See application file for complete search history.

(56) References Cited

U.S. PATENT DOCUMENTS 378,394 A * 2/1888 Haskins ..... A41F 15/007 2/459
960,058 A 5/1910 West
1,000,297 A * 8/1911 Sagerstrom ..... A41D 13/0151 2/459
1,239,980 A * 9/1917 Stewart ..... A41D 13/0506 2/463
1,241,025 A * 9/1917 Stewart ..... A41D 13/0151 2/274
2,598,143 A * 5/1952 Smith ..... A41D 13/0151 2/94
2,986,738 A * 6/1961 Zubiate ..... A41D 13/0151 2/268
3,504,377 A * 4/1970 Biggs, Jr. ..... A63B 71/12 2/460
4,353,133 A * 10/1982 Williams ..... A41D 13/0151 2/268
4,373,211 A * 2/1983 Goudreau ..... A63B 71/12 2/463
4,493,115 A * 1/1985 Maier ..... A41D 13/0151 2/268
4,514,862 A * 5/1985 A'Costa ..... A41D 13/0151 2/268
4,610,034 A * 9/1986 Johnson ..... A41D 13/00 2/2.5
5,742,947 A * 4/1998 Davis ..... A63B 71/12 2/455
5,950,249 A * 9/1999 Clement ..... A63B 71/12 2/463
6,145,134 A * 11/2000 Davis ..... A41D 13/0518 2/247
6,588,023 B1 * 7/2003 Wright ..... F41C 23/08 2/459
6,691,327 B1 * 2/2004 Meyer ..... A41D 13/0512 2/268
7,150,217 B2 12/2006 Kershaw
7,917,972 B1 4/2011 Krueger
2006/0080882 A1 4/2006 McCoy et al.
2008/0201828 A1 8/2008 Kanavage
2013/0117916 A1 * 5/2013 Gomez ..... A41D 13/08 2/459

* cited by examiner

*Primary Examiner* — Richale Quinn
(74) *Attorney, Agent, or Firm* — Resolution Legal Group; Bruce LaBrie

(57) ABSTRACT

An apparatus for protecting a torso. The apparatus includes a generally planar rigid body having a first end and a second end, pads affixed near the first end and second end of the rigid body that face the torso, and a harness attached to the body that holds the protector in a desired location near the torso. The body forms a bridge between the pads to protect a portion of the torso from an impact.

9 Claims, 2 Drawing Sheets

PROTECTIVE BRIDGE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates generally to a protector for an upper torso, and more particularly a protector for the chest area when a user is shooting a firearm such as a rifle or a shotgun.

Current solutions that protect the chest and shoulder area of a firearms user from the recoil of a gun employ various configurations of pads and solid components. Generally, these solutions seek to protect an area from single and multiple recoils by muting the impulse that results from the recoil. This result is typically accomplished by a configuration that distributes the impulse to a larger surface area, thereby reducing the effect of a more finite impulse area. This goal is further accomplished by adding energy absorbing padding that also contributes to muting the impulse of recoil from a firearm. These solutions help to eliminate discomfort. However, these solutions do not eliminate the effects of a recoil impulse to a specific area, they only reduce the effects.

It is often desirable to more thoroughly protect a specific area from the effects of a recoil. For example, a pacemaker implanted in the chest of a firearm user is susceptible to damage from the impulse created by the recoil of the firearm. Similarly, an injury such as a fractured rib could be very painful using only impulse distributing means such as that described above. It is to these ends that the present invention is directed.

BRIEF SUMMARY OF THE INVENTION

In some embodiments the present invention is directed to a protector for an upper torso. The apparatus includes a generally planar rigid body having a first end and a second end. Pads affixed near the first end and second end of the rigid body face the torso. A harness attached to the body holds the protector in a desired location near the torso. The body forms a bridge between the pads to protect a portion of the torso from an impact.

In other embodiments the body is curved away from the torso. The body can include a seat between the first end and the second end. The pads can be one continuous pad that extends from the first end to the second end. The first end can be adjacent a shoulder and the second end can be adjacent a sternum. In yet other embodiments the harness includes a first strap affixed to the first end that extends over the shoulder. The harness can also include a second strap affixed to the first strap and the second end that extends around the torso. The body can also include a raised structural feature to further protect the torso from impact.

DETAILED DESCRIPTION OF THE INVENTION

Figure 1:
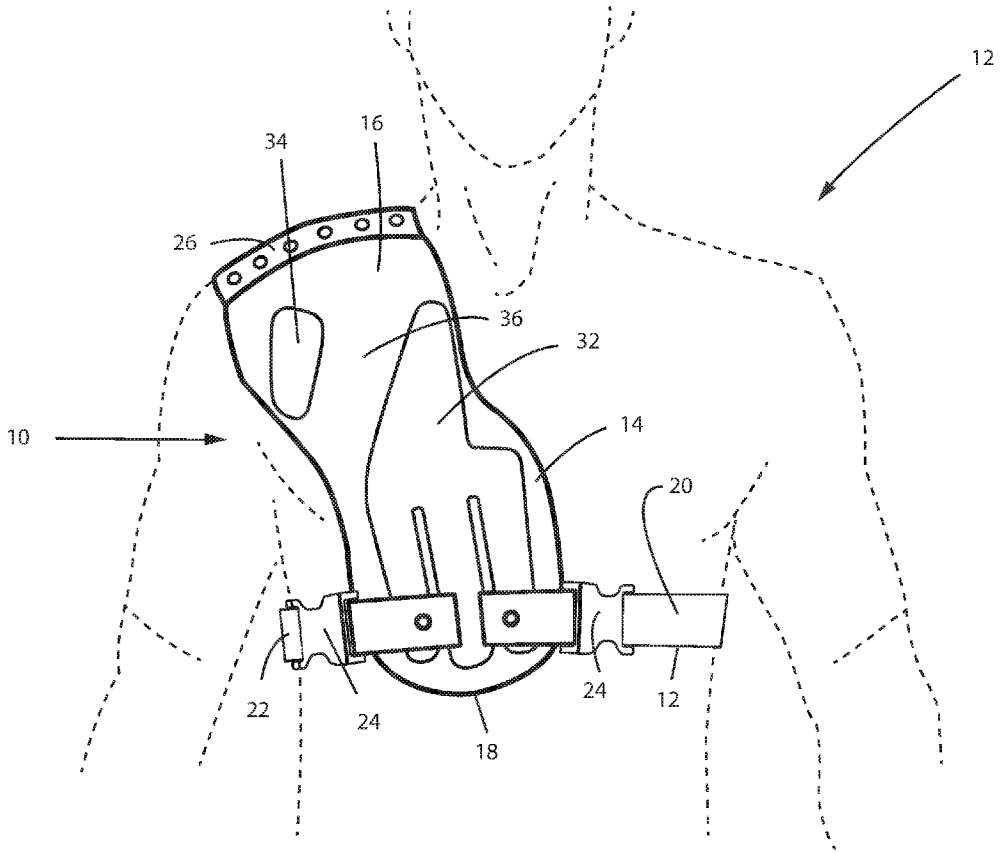
FIG. 1 is a front perspective view of a protective bridge in accordance with the present invention.

Referring now to the drawings, and more particularly to FIG. 1, presently preferred embodiments of a protective bridge are illustrated. A protective bridge 10 is shown in relation to the front side of a human torso 12. A body 14 is shown with a first end 16 and a second end 18. In a presently preferred embodiment, the body 14 is preferably constructed of a high impact plastic polymer, although other materials are well within the scope of the invention as will be evident in this disclosure.

A harness 20 is attached to the body 14 at three presently preferred locations. As shown in FIG. 1, the harness 20 is attached using rivets at two locations near the second end 18 and at one location near the first end 16. Other methods of attachment are appropriate for securing the harness 20 to the body 14, such as adhesive and molding the harness 20 into the body 14 as is readily apparent for the present invention.

Figure 4:
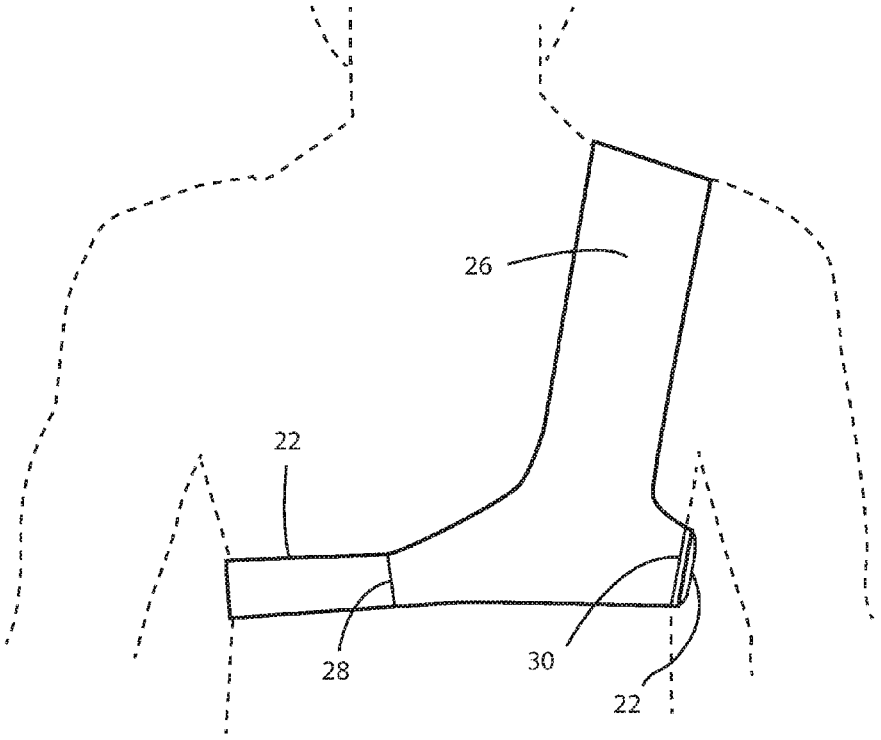
FIG. 4 is a rear perspective view of one aspect of the protective bridge in accordance with the present invention.

In another preferred embodiment, the harness 20 is made of an elastic strap 22 and plastic clips 24. This portion of the harness 20 attaches to the second end 18. In yet another preferred embodiment, the harness 20 is made of a leather strap 26 that attaches to the first end 16 of the body 14. Referring briefly to FIG. 4, the leather strap 26 is shown in relation to the back of an upper torso. Elastic strap 22 is shown attached to leather strap 26, preferably sewn together at locations 28 and 30.

In an alternate preferred embodiment, leather strap 26 is made of two pieces of nearly identical leather sewn together. A third layer, preferably of soft cloth, is sewn between the two leather pieces to form a layer of padding, thereby making the leather strap 26 a padded element itself.

Returning now to FIG. 1, shown therein is a raised structural feature 32, preferably formed of the same material as body 14. An additional raised feature 34 is preferably formed on the surface of body 14. The separation between raised structural feature 32 and raised feature 34 forms seat 36, and forms a flat area between the raised features 32, 34.

Figure 2:
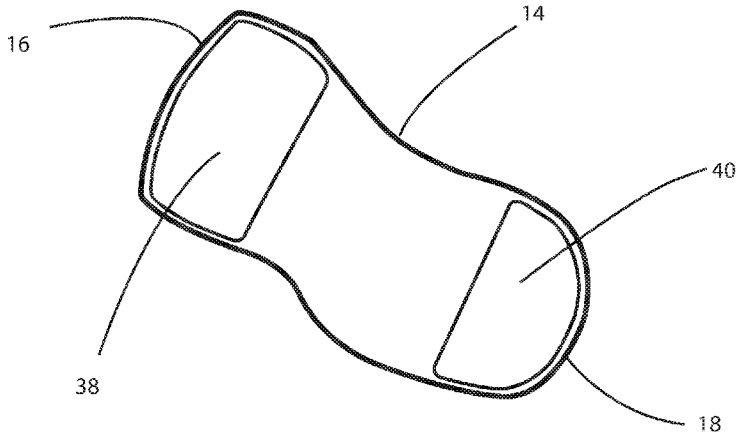
FIG. 2 is a rear perspective view of the protective bridge in accordance with the present invention.

Referring now to FIG. 2, shown therein is the back side of body 14. Pad 38 is attached near first end 16 and pad 40 is attached near second end 18, preferably using a hook and loop fastener. Other methods of attachment can readily be used, such as adhesives. Pads 38, 40 are preferably foam or other soft material surrounded by cloth or similar variations that provide a soft element.

Figure 3:
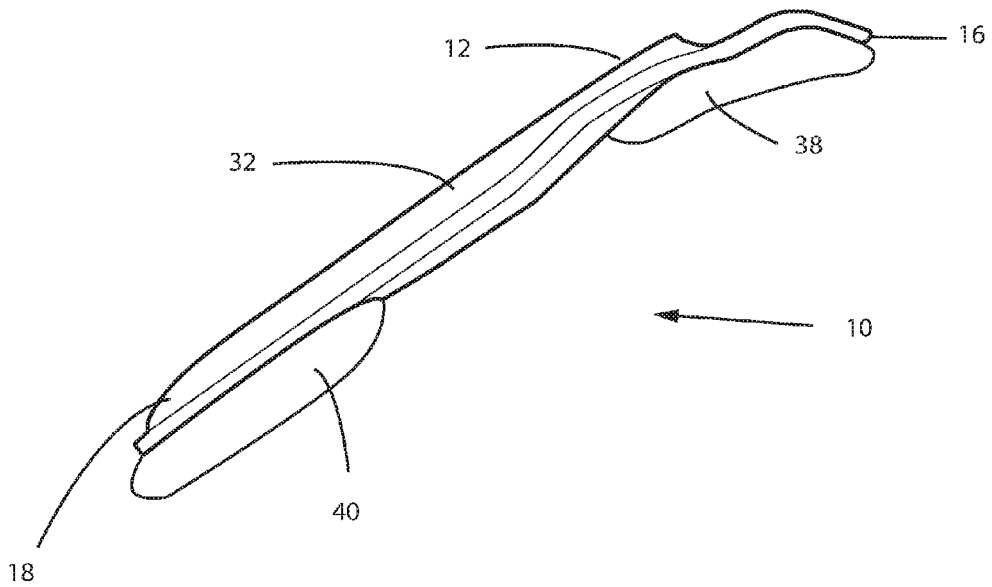
FIG. 3 is a side elevation view of the protective bridge in accordance with the present invention.

Turning now to FIG. 3, shown therein is a side view of protective bridge 10. Body 14 is shown with pads 38, 40 secured to ends 16, 18 respectively. Raised structural feature 32 can also be seen in this view. The curvature of body 14 near end 16 is shown in exaggerated form, although it will be recognized that such degree of curvature is not required for the present invention. Some curvature is presently preferred, yet body 14 is generally planar.

The protective bridge 10 is preferably worn by a user over the upper torso. The body 14 is preferably placed such that pad 38 is adjacent to the shoulder and pad 40 is adjacent to the sternum. The space between pad 38 and pad 40 should be located over the portion of the body that is intended to be protected, such as the location of a pacemaker or an injured or tender rib, for example.

Harness 20 is preferably adjustable to ensure comfort and to properly position the protective bridge 10 in the correct location. One or more of clips 24 can preferably be unfastened to allow the user to wear the apparatus. In another preferred embodiment, the harness 20 is adjustable for comfort and positioning, such as by hook and loop fasteners that permit elastic strap 22 to be loosened and tightened.

A user of protective bridge 10 can place the butt of a gun on seat 36 while shooting. The flat area of seat 36 surrounded by features 32, 34 provides a secure area by which the gun is retained in a proper position. Although body 14 is likely to deflect during recoil of the firearm, the body is preferably maintains rigidity such that the body 14 does not deflect enough to contact the torso. Additionally, raised structural feature 32 provides additional structural support to help resist the impulse caused by the recoil beyond just the material strength of the body 14.

Alternatively, the protective bridge 10 can be used to protect other portions of the torso that may be susceptible to injury or pain. Adjustment or reconfiguration of the harness 20 can allow the placement of the protective bridge 10 to be placed in alternate locations. Additionally, the protective bridge 10 can also be used for other sports in which an impact can cause injury.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present disclosure.

I claim:

1. A protector for a chest, comprising:

a generally planar single piece continuous rigid body having a first end and a second end;

coplanar pads affixed and separately spaced on an interior surface of the rigid body near the first end and second end for use between the rigid body and the chest, such that the first end is configured to engage a shoulder and the second end is configured to engage a sternum;

a harness attached to the rigid body that holds the protector in a desired location near the chest wherein the harness comprises a first strap affixed to the first end adapted to extend over the shoulder and a second strap affixed to the first strap and the second end adapted to extend around the chest;

wherein the rigid body forms a raised bridge and a space between the coplanar pads to protect a portion of the chest from an impact.

2. The protector of claim 1, further comprising a seat on an exterior surface of the rigid body between the first end and the second end configured to engage the butt of a gun.

3. The protector of claim 1, wherein the rigid body comprises a raised structural feature on an exterior surface of the rigid body to further protect the chest from impact.

4. A protector for a chest, comprising:

a generally planar single piece rigid body having a first end and a second end, the first end configured to engage a shoulder and the second end configured to engage a sternum;

a harness comprising a first strap affixed to the first end that extends over the shoulder and a second strap affixed to the first strap and the second end that extends around the chest;

coplanar pads affixed and separately spaced on an interior surface of the rigid body near the first end and second end for use between the rigid body and the chest;

wherein the rigid body forms a raised bridge and a space between the pads to protect a portion of the chest from an impact.

5. The protector of claim 4, further comprising a harness attached to the rigid body that holds the protector in a desired location near the chest.

6. The protector of claim 4, further comprising a seat on an exterior surface of the rigid body between the first end and the second end configured to engage the butt of a gun.

7. The protector of claim 4, wherein the rigid body comprises a raised structural feature on an exterior surface to further protect the chest from impact.

8. A protector for a chest, comprising:

a generally planar single piece continuous rigid body having a first end and a second end wherein the first end is configured to engage a shoulder and the second end is configured to engage a sternum;

a harness attached to the rigid body that holds the protector in a desired location near the chest comprising a first strap affixed to the first end that extends over the shoulder and a second strap affixed to the first strap and the second end that extends around the chest;

wherein the rigid body forms a raised bridge between the first end and the second end to protect a portion of the chest from an impact and further comprising a seat on an exterior surface of the rigid body between the first end and the second end configured to engage the butt of a gun.

9. The protector of claim 8 further comprising coplanar pads affixed and separately spaced to an interior surface of the rigid body near the first end and second end for use between the rigid body and the chest.

* * * * *